United States Patent [19]

Dahmen

[11] 4,154,567

[45] May 15, 1979

[54] METHOD AND APPARATUS FOR THE COMBUSTION OF WASTE GASES

[75] Inventor: Karel R. Dahmen, Houston, Tex.

[73] Assignee: Continental Carbon Company, Houston, Tex.

[21] Appl. No.: 757,532

[22] Filed: Jan. 7, 1977

[51] Int. Cl.[2] ..... F23D 13/20; F23J 15/00

[52] U.S. Cl. ..... 431/5; 431/9; 431/284; 422/182

[58] Field of Search ..... 431/5, 9, 284, 285, 431/173, 174, 351, 352, 353, 158; 23/277 C, 259.5; 239/402, 403, 405, 406

[56] References Cited

U.S. PATENT DOCUMENTS

| | | | |
|---|---|---|---|
| 2,753,925 | 10/1956 | Campbell et al. | 431/5 |
| 3,195,608 | 7/1965 | Voorheis et al. | 431/5 |
| 3,376,098 | 2/1968 | Pryor | 431/284 |
| 3,671,172 | 6/1972 | Chedaille et al. | 431/284 |
| 3,677,532 | 7/1972 | Wolfsperger | 431/9 |
| 3,852,023 | 12/1974 | Itoh et al. | 431/5 |
| 3,985,494 | 10/1976 | Childree | 431/5 |
| 3,993,449 | 11/1976 | Childs | 431/9 |

*Primary Examiner*—Henry C. Yuen
*Attorney, Agent, or Firm*—Jerry B. Peterson

[57] ABSTRACT

A combination burner, consisting of a main swirl burner in which gases of very low calorific value such as industrial waste gases can be burned and a secondary burner for ignition and support of the main burner in which fuels with high calorific value such as natural gas or fuel oil can be burned.

The combination burner is designed so that the flame of the secondary burner (upstream of and coaxial with the waste gas burner) will have stability, ignition capability and invulnerability to quenching even in open contact with the swirling waste gas and even when the composition of the waste gas becomes temporarily insufficient to sustain combustion. This is accomplished by aerodynamics utilizing a low swirl in the secondary burner, as compared to the higher swirl of the waste gas burner to sufficiently stabilize the flame of the secondary burner by recirculation but providing an outward flow pattern which forms an effective barrier for the reverse vortex flow in the waste gas swirl chamber.

6 Claims, 5 Drawing Figures

METHOD AND APPARATUS FOR THE COMBUSTION OF WASTE GASES

BACKGROUND OF THE INVENTION

This invention relates to the combustion of industrial waste gases having relatively low calorific value, including but not limited to the combustion of waste gases produced in carbon black plants. Recovery of heat (hence energy conservation) and/or elimination of certain atmospheric pollutants are the desired objectives of the invention.

The shortage and increasing prices of natural gas are strong incentives for development of combustion systems capable of efficiently burning such low calorific value waste gases to furnish energy which would otherwise need to be generated by consumption of natural gas or oil.

Cyclone or rotary flow combustors of the type consisting of a cylindrical combustion chamber with a restricted outlet and provided with a swirl burner mounted in the front wall of the combustor and coaxial with the combustion chamber for the introduction of waste gas and air and subsequent ignition upon entering the combustion chamber, have been successfully utilized. The aerodynamics of certain combustors of this type are characterized by rotary flow throughout the combustion chamber and a broad field of axially reverse flow in the first section occupying approximately one-third of the length of the combustion chamber. In this section hot combustion products are recirculated and mixed with the incoming mass of waste gas and air, thereby increasing the temperature sufficient to maintain them above the ignition temperature. The remaining volume of the combustion chamber, approximately two-thirds, is utilized to complete combustion of the waste gas. Numerous studies in which swirling jets are introduced in the front walls of enclosed cylindrical furnaces as a means to control and improve the combustion dynamics have been reported. The following studies describe techniques utilizing ratios between the burner or swirl chamber exit diameter and the combustion chamber diameter of one-fourth and higher, which is characteristic for the dimensions of the equipment used in the subject invention.

1. "Study of the Aerodynamics of A Furnace Space," by V. N. Afrosimova, Teploenergetika, 1967 14 (1) 9–13.

2. "An Investigation of the Behavior of Swirling Jet Flows in a Narrow Cylindrical Furnace," by H. L. Wu and N. Fricker, Chapter IX of the proceedings of the International Flame Research Foundation.

One of the objectives of this invention was to develop a burner which would be smaller and less costly than a combustor consisting of a burner assembly plus a large combustion chamber and to install a plurality of such burners in the walls of existing fireboxes used to provide the heat required in a rotary drying kiln or drum as are used for instance in, but not limited to, the drying of wet pellets in the manufacture of carbon black. In this application only the ignition section of the combustion chamber is maintained as an enclosed refractory lined cylinder, but completion of the combustion has to be achieved outside this cylinder in the firebox of the drying kiln. This application requires a temperature to sustain combustion which is higher than the temperature generated by the waste gases in the lower range of caloric value — that is from 36 to 44 BTU/SCF Net. It is therefore essential that the burner arrangement incorporates a supporting burner for natural gas, propane or the like, or oil, to provide the heat to sustain ignition and combustion of the waste gas and even to provide sufficient heat to the drying drum to dry the desired throughput of carbon black pellets when no waste gas is available or when the heating value of waste gas has been reduced to the extent that it cannot by itself sustain combustion. Such a burner should also incorporate a pilot flame to ensure that the supporting gas or liquid fuel will ignite inside the burner assembly and not escape unburned into the firebox where it is liable to cause an explosion. The requirements for this supporting burner are: the capability to maintain combustion at high loads and at very low loads under adverse conditions; that is, with large flows of often unburnable waste gas in open contact with the flame and even to ignite under these conditions from the pilot flame. The pilot flame should also be completely unaffected by the quenching gas flow. Without this capability the entire operation of the drying drum becomes an explosion hazard. In order to maintain the desired simplicity in design and dimensional limit, it is highly desirable that this burner should either be completely enclosed within the waste gas burner assembly or extend coaxially a short distance outside this assembly.

The basic problem involved in realizing these objectives was the proper design and location of the supporting gas or oil burner, so that the supporting gas flame would not be extinguished. One or more gas burners located in the burner throat or in the upstream zone of the combustion chamber could successfully ignite the waste gas. However, in these locations, they could not survive the flow of low quality waste gas or even less than very cautiously controlled increments of good quality waste gas. These locations would also be prohibitive for a reliable pilot flame. The alternative solution would be a supporting burner upstream of and coaxial with the waste gas swirl chamber. The supporting flame should have its stable root and ignition point at the burner mouth upstream of the waste gas swirl chamber and should traverse through this swirl chamber without expanding and impinging on the unprotected swirl chamber casing. To obtain the required stability and narrow flame shape of the supporting flame within the dimensional limits again required aerodynamics based on a swirl; however, this swirl, combined with the swirl of the waste gas burner, created a central reverse flow by which waste gas penetrated into the root of the supporting flame and extinguished it. Operating the supporting burner under straight, that is nonswirling flow, would draw the flame out too long, and it would actually be extinguished when the forward part was quenched by the waste gas.

BRIEF SUMMARY OF THE INVENTION

This invention overcame these problems and realized these objectives by employing two different Swirl Numbers (as hereinafter defined), namely a high Swirl Number ("S") of about 1.5–3.0 for the low calorific value waste gases and a low Swirl Number of about 0.25–0.50 in the supporting fuel burner, in a combination rotary flow combustor having a rotary-flow supporting burner located upstream of and coaxial with the waste gas swirl chamber.

The use of the low swirl in the supporting burner provides a flame strongly stabilized at the root by a short reverse flow zone but having at the outlet of the supporting burner an outward flow strong enough to form a barrier for the reverse vortex flow of the waste gas swirl chamber. The results provide a remarkably stable flame and ignition capability under the most adverse conditions resulting from the highly-swirling waste gases.

Combustion of waste gas of heating value lower than 50 BTU/ft$^3$ can be successfully done in relatively small burner arrangements in which a mixture of waste gas and air is introduced into a swirl generator and subsequently flows in swirling motion through a restricted passage and expands into a short cylindrical combustion chamber. Burners with a heat release of 1,500,000 BTU/hour have been developed with dimensions that make it possible to install a plurality of such burners in the wall of a firebox used to provide the heat required for carbon black wet pellet drying drums, the length protruding outside the wall of the firebox not exceeding 2½ feet and the length extending into the firebox limited to 3 feet.

DESCRIPTION OF THE PREFERRED EMBODIMENTS

Figure 1:
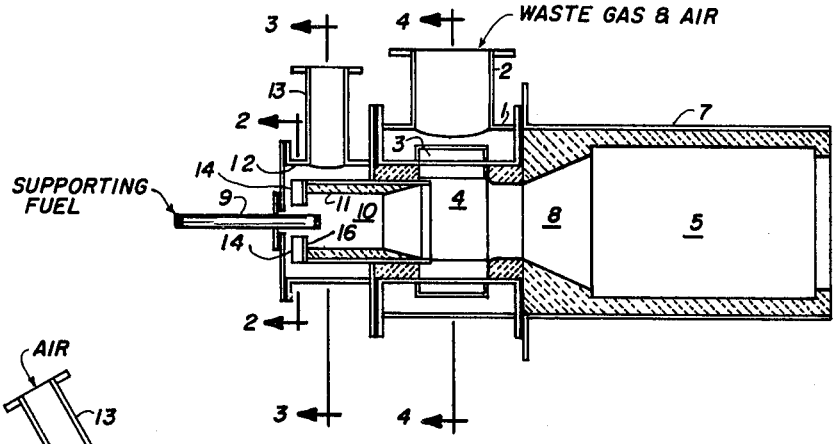
FIG. 1 is a longitudinal sectional view illustrating a preferred embodiment of the invention.
Figure 3:
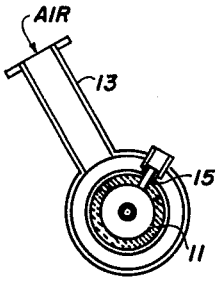
FIG. 3 is a sectional view taken along the line 3—3 of FIG. 1.
Figure 2:
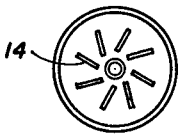
FIG. 2 is a sectional view taken along the line 2—2 of FIG. 1.
Figure 4:
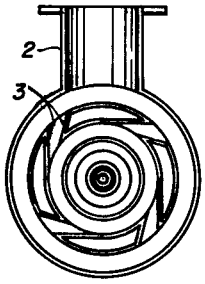
FIG. 4 is a sectional view taken along the line 4—4 of FIG. 1.

Referring to FIGS. 1–3, the mixture of waste gas and air enters plenum chamber 1 through pipe 2 and is given a high swirl by waste gas swirl generator or swirling means 3 before entering swirl zone 4. The swirling gas-air mixture passes into the combustion chamber preferably through a restriction 8 and subsequently expands and ignites in the cylindrical combustion zone 5 defined by refractory-lined combustion chamber 7. Optionally, the transition between the restricted inlet 8 and the full width of the combustion chamber 5 can be tapered as shown in FIG. 1. Alternatively, the waste gas and air can be introduced separately into swirl zone 4 rather than premixed.

The high temperature required for the initial ignition of waste gas is supplied by the supporting burner. The fuel for this burner is introduced through pipe 9 into the combustion zone 10 defined by refractory lined tube 11. The flame of this supporting burner, hereinafter called the "supporting flame," is formed and stabilized within zone 10. The hot combustion products traverse swirl zone 4 in a narrow pattern and full mixing and exchange of heat with the waste gas is effected in restricted zone 8. Tube 11 has sufficient length to give added protection to the supporting flame and extends into swirl zone 4 in order to reduce expansion of the flame into the outer circumference of zone 4, which would cause overheating of the metal parts of the waste gas swirl generator 3. This extension also limits the axial dimension of the assembly.

The supporting fuel may be natural gas or oil. The particular design of the supporting burner tip at the end of fuel pipe 9 is not critical. Air for combustion of the supporting fuel enters by pipe 13 (FIG. 3) into the plenum between burner tube 11 and housing 12 and is given a swirling motion by means of swirling vanes 14 after which it passes restriction 16 to enter zone 10. A pilot (not shown) for initial ignition of the supporting fuel is preferably inserted into passageway 15.

As indicated above, a critical feature of this invention is the use of a low swirl in supporting burner combustion zone 10 and a high swirl in the swirl zone 4. The Swirl Number, "S" in zone 10 should be about 0.25–0.50; and the Swirl Number in zone 4 should be about 1.5–3.0, preferably about 1.8–2.4.

The Swirl Number "S" is utilized as a nondimensional parameter to define and to control the aerodynamic behavior in the various zones of this combination burner. For this application the ratio is used of the moment about the central axis of the angular momentum to the product of the axial outward thrust and the radius of the exit. For the waste gas swirl generator, the factors in the numerator are defined by the tangential inlet velocity provided by swirling means 3, and the radius of the circle with the distance between the centers of gravity of these ports as its diameter; the factors in the denominator are defined by the axial outlet velocity through restriction 8 and the radius of the same. For the supporting burner these factors are defined by the angular momentum given by the swirling vanes 14 and the outlet flow through restriction 16 and its radius, respectively.

Figure 5:
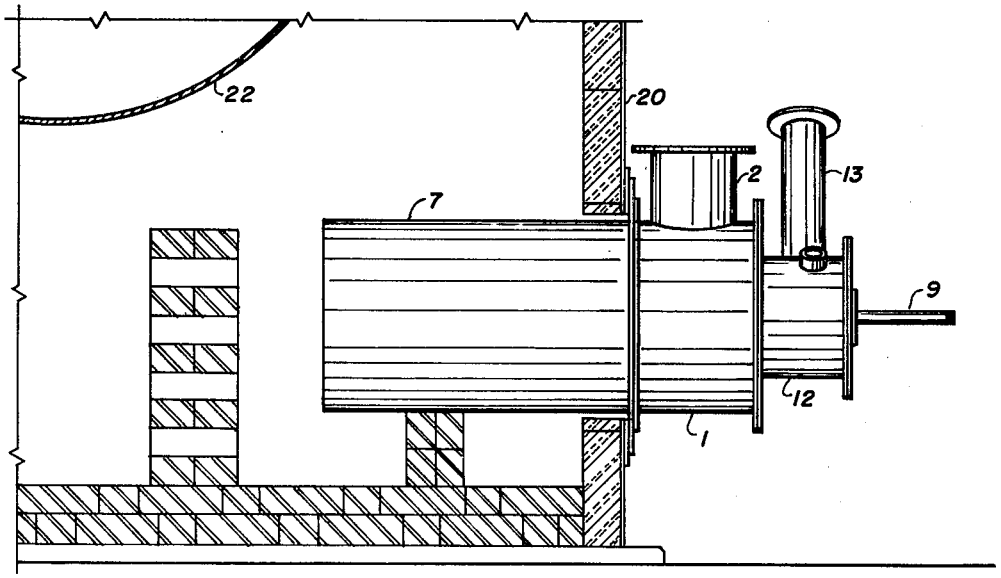
FIG. 5 is a sectional elevation illustrating a suitable orientation of the invention in combination with a firebox of a carbon black pellet drum dryer.

FIG. 5 is included simply to illustrate the orientation of a preferred embodiment of the invention installed in the firebox of a cylindrical rotary drum dryer 22 for wet carbon black pellets.

In a commercial carbon black plant, a plurality of combustors are installed for each drum dryer.

EXAMPLES

For one tread grade carbon black unit, a drum dryer is equipped with eight combustors as shown in the drawings, which are drawn to scale (¾" = 1 foot).

The supporting fuel (natural gas) burner pipe 9 is plugged at the downstream end and the gas exits the pipe through six ⅛" diameter holes (not shown) drilled radially through the pipe wall near its downstream end.

Each burner is designed to burn approximately 30,000–36,000 SCFH of waste gases having the composition (approximate) shown in Table 1.

Table 1

| | Mole Percent | |
|---|---|---|
| | Example 1 | Examples 2–4 |
| $H_2$ | 5.67 | 7.80 |
| A | 0.43 | 0.43 |
| $CO_2$ | 2.96 | 2.61 |
| $N_2$ | 37.51 | 35.27 |
| $C_2H_2$ | 0.43 | 0.43 |
| $CH_4$ | 0.24 | 0.27 |
| CO | 5.76 | 6.19 |
| $H_2O$ | 47.00 | 47.00 |
| Calorific value, BTU/Ft.$^3$ Net | 42.55 | 50.05 |

Table 2 lists typical examples of operating conditions for each combustor.

Table 2

| | Example 1 | Example 2 | Example 3 |
|---|---|---|---|
| Calorific value of waste gas, BTU/Ft.$^3$ | 42.55 | 50.05 | 0 |
| Waste gas rate, SCFH | 35,119 | 30,000 | 30,000 |
| Air rate, for air/waste gas mixture, SCFH | 8,800 | 12,000 | 3,000 |
| Swirl Number, zone 4 | 2 | 2 | 2 |

Table 2-continued

| | Example 1 | Example 2 | Example 3 |
|---|---|---|---|
| Supporting fuel (natural gas) rate, SCFH | 250 | 0 | 1,000 |
| Air rate, into pipe 13 | 3,000 | 1,000 | 10,500 |
| Swirl Number, zone 10 | 0.25 | 0.25 | 0.25 |

While I have thus described the preferred embodiments of the present invention, many variations will be suggested to those skilled in the art. The foregoing description and examples should therefore not be considered limitative; and all such variations and modifications as are in accord with the principles described are meant to fall within the scope of the appended claims. For example, the specific configuration and dimensions of the combustor could be varied depending upon the composition and volumes of waste gases to be burned and the type of available supporting fuel, and the required heat duty per burner.

I claim:

1. The method of burning industrial waste gases of low calorific value of about 35–60 BTU/ft$^3$ comprising the steps of combusting a swirling mixture of said gases and air utilizing a Swirl Number of about 1.5–3.0, said combustion being initiated by combustion of a supporting fuel utilizing a Swirl Number of about 0.25–0.50 for the mixture of fuel and air.

2. The method of claim 1 in which said waste gases are from the manufacture of carbon black.

3. The method of claim 1 in which said waste gases are from the manufacture of carbon black and have a calorific value of about 36–44 BTU/Ft$^3$.

4. Apparatus for the combustion of industrial waste gases comprising:

a first plenum chamber containing swirling means for entry of waste gases and air into a swirl zone under swirling conditions of Swirl Number of about 1.5–3.0;

a second refractory-lined chamber for entry of air under swirling conditions of Swirl Number of about 0.25–0.50, said second chamber being positioned upstream of and axially aligned with said first plenum chamber;

said swirl zone being in open communication with said second chamber;

means for injection of supporting fuel into said second chamber; and a refractory-lined combustion chamber for the combustion of said waste gases, said combustion chamber being positioned downstream of and axially aligned with said first chamber, said combustion chamber being in open communication with said first chamber.

5. The apparatus of claim 4 in which said combustion chamber has a diameter greater than the diameter of said swirl zone.

6. The apparatus of claim 5 in which said combustion chamber is separated from said swirl zone by a restriction.

* * * * *